US008824917B2

(12) United States Patent
Takahashi

(10) Patent No.: US 8,824,917 B2
(45) Date of Patent: Sep. 2, 2014

(54) DEVELOPER SUPPLYING APPARATUS

(75) Inventor: Keisuke Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 63 days.

(21) Appl. No.: 13/615,724

(22) Filed: Sep. 14, 2012

(65) Prior Publication Data

US 2013/0164024 A1 Jun. 27, 2013

(30) Foreign Application Priority Data

Dec. 26, 2011 (JP) ..... 2011-283500

(51) Int. Cl.
*G03G 15/08* (2006.01)

(52) U.S. Cl.
USPC ..... 399/103

(58) Field of Classification Search
CPC ..... G03G 15/0805; G03G 15/817; G03G 15/0898
USPC ..... 399/102, 103, 105, 106, 287
See application file for complete search history.

(56) References Cited

U.S. PATENT DOCUMENTS 4,407,228 A 10/1983 Takano et al.

FOREIGN PATENT DOCUMENTS

| | | | | |
|---|---|---|---|---|
| JP | 57-064266 A | | 4/1982 | |
| JP | 57-108870 A | | 7/1982 | |
| JP | 58-057156 A | | 4/1983 | |
| JP | 58-058568 A | | 4/1983 | |
| JP | 61230176 A | * | 10/1986 | ..... G03G 15/09 |
| JP | 2010-276720 A | | 12/2010 | |

* cited by examiner

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

A developer supplying apparatus includes a developer carrying member, a casing, and a side seal. The developer carrying member includes a roller body and a brush part having fibrous members disposed on the peripheral surface. The developer carrying member is configured to carry a developer at the brush part. The casing includes a developer storing portion configured to store the developer, and has an opening formed along a rotation axis of the developer carrying member. The casing is configured to support the developer carrying member rotatably such that the brush layer is exposed outside from the opening. The side seal is disposed in an end of the opening in a direction along the rotation axis of the developer carrying member such that the side seal protrudes toward the brush layer to press the brush layer toward the rotation axis.

8 Claims, 3 Drawing Sheets

DEVELOPER SUPPLYING APPARATUS

CROSS REFERENCE TO RELATED APPLICATION

This application claims priority from Japanese Patent Application No. 2011-283500, filed on Dec. 26, 2011, the content of which is incorporated herein by reference in its entirety.

TECHNICAL FIELD

Aspects of the disclosure relate to a developer supplying apparatus configured to supply powder developer (or dry developer, more specifically mono-component non-magnetic developer).

BACKGROUND

As the above developer supplying apparatus, a brush roller used as a developer carrier (or developing roller) is known.

SUMMARY

Aspects of the disclosure may provide a developer supplying apparatus using a brush roller and being configured to reduce leakage of a developer outside at both ends in an axial direction of the brush roller.

According to one aspect of the disclosure, a developer supplying apparatus is configured to supply a developer, which is powdery, to a target. The developer supplying apparatus includes a developer carrying member, a casing, and a side seal. The developer carrying member includes a roller body having a cylindrical peripheral surface, and a brush part having a number of fibrous members disposed on the peripheral surface. The developer carrying member is configured to carry the developer at the brush part. The casing includes a developer storing portion configured to store the developer to be carried on the brush layer, and has an opening formed along a rotation axis of the developer carrying member. The casing is configured to support the developer carrying member rotatably such that the brush layer is exposed outside from the opening and faces the target. The side seal is disposed in an end of the opening in a direction along the rotation axis of the developer carrying member such that the side seal protrudes toward the brush layer to press the brush layer toward the rotation axis. The side seal is configured to reduce leakage of the developer outside at the end of the opening.

BRIEF DESCRIPTION OF THE DRAWINGS

Illustrative aspects of the disclosure will be described in detail with reference to the following figures in which like elements are labeled with like numbers and in which.

DETAILED DESCRIPTION

A first illustrative embodiment of the disclosure will be described in detail with reference to the accompanying drawings.

Figure 1:
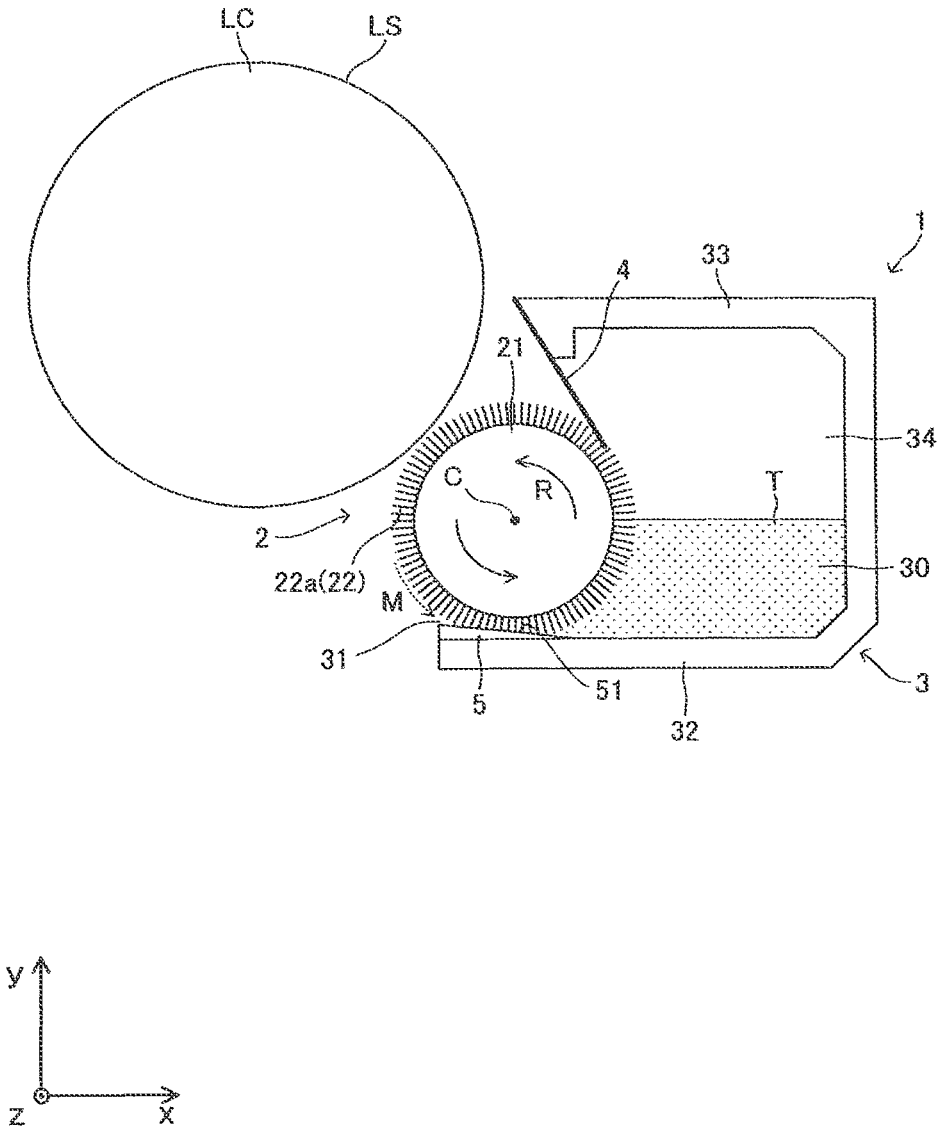
FIG. 1 is a sectional side elevation of a toner supplying apparatus according to a first illustrative embodiment of the disclosure.

Referring to FIG. 1, a toner supplying apparatus 1 is configured to supply a toner T, which is a powder non-magnetic mono-component developer, to an electrostatic latent image carrying surface LS, which is a peripheral surface of a photosensitive drum LC as a target to be supplied and carries an electrostatic latent image to be formed thereon. Specifically, the toner supplying apparatus 1 includes a developing roller 2, a casing 3, a regulating blade 4 and a side sealing member 5.

The developing roller 2, as a developer carrying member of the disclosure, is a rotating member driven to rotate about a center axis C in a specified rotation direction R (or a counterclockwise direction in FIG. 1). The developing roller 2 is a known brush roller having a known structure similar to that disclosed in JP 57-64266, JP57-108870, and JP58-57156. Specifically, the developing roller 2 includes a roller body 21 having a cylindrical peripheral surface and a brush layer 22 having a plurality of flexible fibrous members 22*a* disposed on the peripheral surface. The developing roller 22 is configured to carry the toner T in the brush layer 22.

The casing 3 is a boxy member having a toner storing portion 30 (which is a space for storing toner to be carried on the brush layer 22), and is made of a hard synthetic resin such as polystyrene. The casing 3 has an opening 31 formed along the center axis C. Specifically, the opening 31 is defined by an end of a bottom plate 32 of the casing 3 closer to the photosensitive drum LC (hereinafter the end closer to the photosensitive drum LC is referred to as a front end), a front end of a top plate 33, and front ends of a pair of side plates 34. The casing 3 is configured to support the developing roller 2 rotatably such that the brush layer 22 is exposed outside in the opening 31 to face the photosensitive drum LC.

The regulating blade 4 is configured to regulate an amount of the toner T carried on the brush layer 22 by scraping a part of the toner T temporarily carried on the brush layer 22. Specifically, the regulating blade 4 is a thin-plate member made of stainless steel, and is fixed to the casing 3 at an upstream end of the opening 31 in a moving direction M (indicated by a broken line in FIG. 1) of the brush layer 22 exposed in the opening 31 toward the photosensitive drum LC by rotation of the developing roller 2. In other words, the regulating blade 4 is disposed such that the regulating blade 4 extends from a downstream side to an upstream side in the rotation direction of the developing roller 2 with respect to a base end portion of the regulating blade 4 fixed to the casing 3 (or extends in a direction opposite to the moving direction M).

Figure 2:
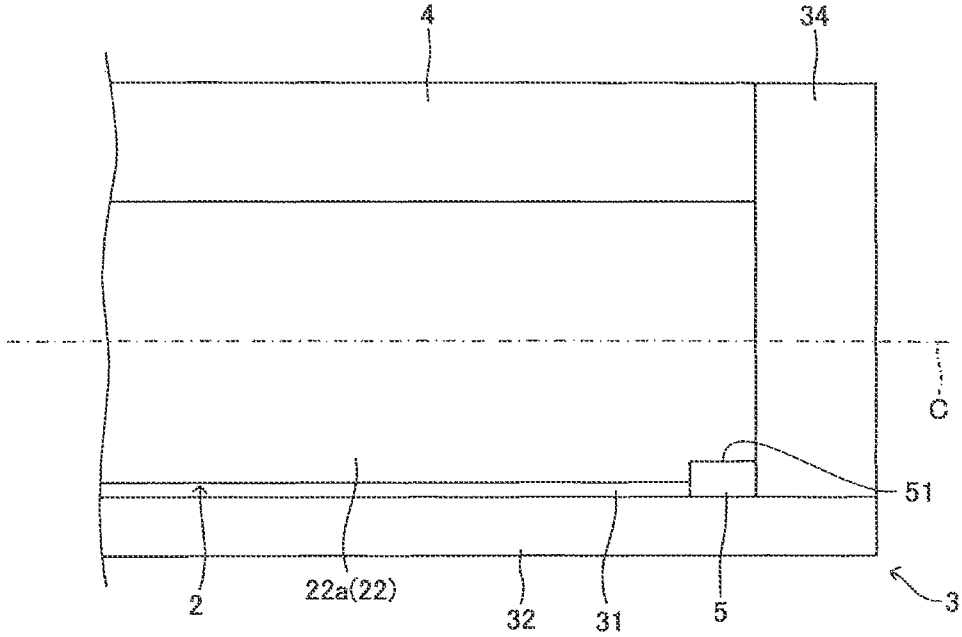
FIG. 2 is an enlarged front view of one end of a developing roller, shown in FIG. 1, in a direction along an axial direction of the developing roller.
Figure 2:
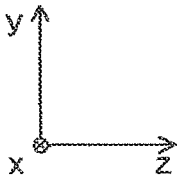

Referring to FIGS. 1 and 2, the structure of a side seal member 5 will be described in details.

The side seal member 5 is configured to reduce leakage of the toner T outside at each end of the opening 31 in a direction along the center axis C, and is made of a hard synthetic resin such as polystyrene, which is not for rubbers and sponges. In this embodiment, the side seal member 5 is made of the same material as that for the casing 3.

The side seal member 5 is disposed in the casing 3 such that the side seal member 5 protrudes toward the brush layer 22 at each end of the opening in the direction along the center axis C to press the brush layer 22 toward the center axis C. Specifically, the side seal member 5 is disposed at the front end of the bottom plate 32 and in the vicinity thereof such that the side seal member 5 presses the brush layer 22 upward (toward a y direction in FIG. 1) at each end in the direction along the center axis C of the developing roller 2.

In this embodiment, the side seal member 5 is disposed such that an amount of which the side seal member 5 presses the brush layer 22 toward the center axis C becomes maximum at a central portion of the side seal member 5 in the moving direction M. In other words, the side seal member 5 is shaped such that the amount of which the side seal member 5 presses the brush layer 22 toward the center axis C varies gradually. In addition, an upper surface 51 of the side seal member 5, which faces the brush layer 22, is formed having a smooth surface such as to reduce sliding resistance of the brush layer 22 on the side seal upper surface 51.

In the toner supply apparatus 1 having the above structure, the side seal member 5 presses the brush layer 22 toward the center axis C at each end of the opening 31 in the direction along the center axis C (or each end of the developing roller 2 in the direction along the center axis). Thus, in the toner supplying apparatus 1 using the developing roller 2 which is a brush roller, leakage of the toner T at each end of the opening 31 in the direction along the center axis C can be reliably prevented.

In this embodiment, the side seal member 5 is shaped such that the amount of which the side seal member 5 presses the brush layer 22 toward the center axis C varies gradually. In addition, the upper surface 51 of the side seal member 5 is formed having a smooth surface such as to reduce the sliding resistance of the brush layer 22 on the upper surface 51. Thus, according to the structure of the embodiment, the side seal performance is maintained and rotational resistance of the developing roller 2 can be reduced as much as possible.

The following will describe representative modifications of the toner supplying apparatus 1. It is noted that elements similar to or identical with those shown and described in the above embodiment are designated by similar numerals, and thus the description thereof can be omitted for the sake of brevity.

The embodiment of the disclosure shows, but is not limited to, that the target to be supplied of the disclosure is the photosensitive drum. For example, the disclosure may be applied to flat plate-type and endless belt-type photosensitive members. Alternatively, the disclosure may be applied to image forming apparatus except for electrophotographic type (for example, image forming apparatus for toner jet type, ion flow type, multi-stylus type, and other types that do not use photosensitive members). In this case, recording media such as sheets of paper and aperture electrodes (disclosed in U.S. Pat. No. 5,293,181, for example) may apply to the target to be supplied of the disclosure.

The embodiment of the disclosure shows, but is not limited to that the material of the regulating blade 4 is metal. The material of the regulating blade 4 may be a synthetic resin. In this case, to control charging phenomenon, a (semi-) conductive synthetic resin may be used as the material of the regulating blade 4.

Figure 3:
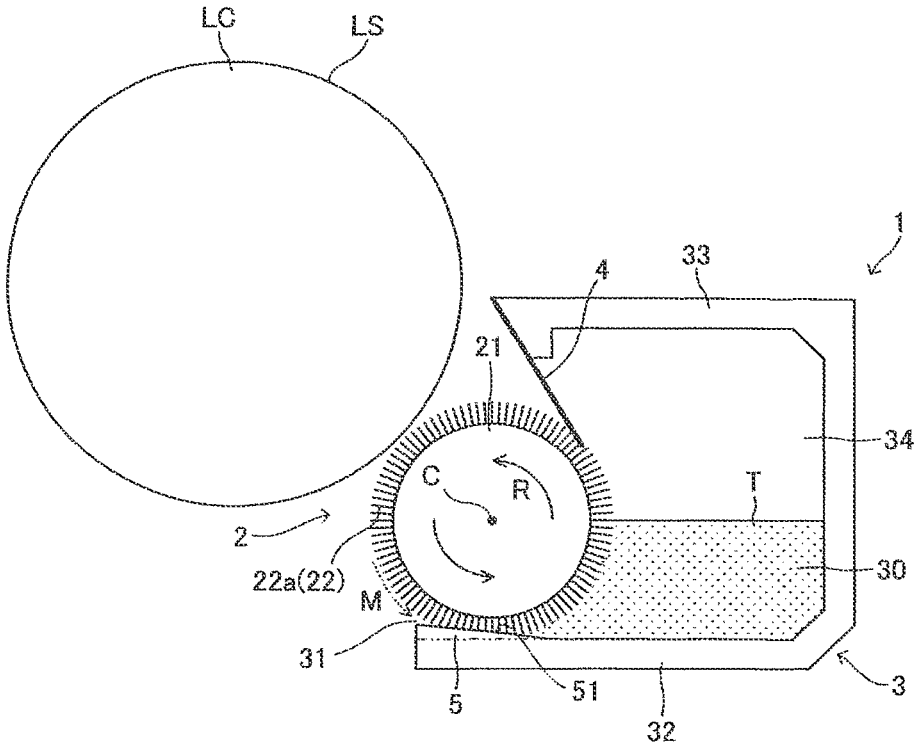
FIG. 3 is a sectional side elevation of a toner supplying apparatus modified from the toner supplying apparatus shown in FIG. 1.
Figure 3:
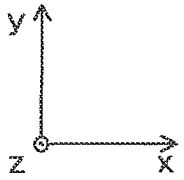

FIG. 3 is a sectional side elevation illustrating a modification of the toner supplying apparatus 1 shown in FIG. 1. As shown in FIG. 3, the side seal member 5 is integrally formed with the bottom plate 32 or the side plate 34 of the casing 3 without seams.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. A developer supplying apparatus configured to supply a developer, which is powdery, to a target, the developer supplying apparatus comprising:

a brush roller including:

a roller body having a cylindrical peripheral surface; and a brush part having a number of fibrous members disposed on the cylindrical peripheral surface of the roller body, the brush roller being configured to carry the developer at the brush part and to rotate about a rotation axis;

a casing including a developer storing portion configured to store the developer to be carried on the brush part, the casing having an opening formed along the rotation axis of the brush roller, the casing being configured to support the brush roller rotatably such that the brush part is exposed outside from the opening and faces the target; and a side seal disposed in an end of the opening in a direction along the rotation axis of the brush roller such that the side seal protrudes toward the brush part to press the brush part toward the rotation axis, the side seal being configured to reduce leakage of the developer outside at the end of the opening.

2. The developer supplying apparatus according to claim 1, wherein the side seal protrudes toward the brush part such that an amount of which the side seal presses the brush part toward the rotation axis becomes maximum at a central portion of the side seal in a direction in which the brush part moves by rotation of the brush roller.

3. The developer supplying apparatus according to claim 1, wherein the side seal has a smooth surface facing the brush to reduce sliding resistance between the side seal and the brush part.

4. The developer supplying apparatus according to claim 1, wherein the casing and the side seal are made of a synthetic resin.

5. A developer supplying apparatus configured to supply a developer, which is powdery, to a target, the developer supplying apparatus comprising:

a brush roller including:

a roller body having a cylindrical peripheral surface; and a brush part having a number of fibrous members disposed on the cylindrical peripheral surface of the roller body, the brush roller being configured to carry the developer at the brush part and to rotate about a rotation axis; and a casing including a developer storing portion configured to store the developer to be carried on the brush part, the casing having an opening formed along the rotation axis of the brush roller, the casing being configured to support the brush roller rotatably such that the brush part is exposed outside from the opening and faces the target, the casing including a side seal disposed in an end of the opening in a direction along the rotation axis of the brush roller such that the side seal protrudes toward the brush part to press the brush part toward the rotation axis, the side seal being configured to reduce leakage of the developer outside at the end of the opening.

6. The developer supplying apparatus according to claim 5, wherein the side seal protrudes toward the brush such that an amount of which the side seal presses the brush part toward the rotation axis becomes maximum at a central portion of the side seal in a direction in which the brush moves by rotation of the brush roller.

7. The developer supplying apparatus according to claim 5, wherein the side seal has a smooth surface facing the brush to reduce sliding resistance between the side seal and the brush part.

8. The developer supplying apparatus according to claim 5, wherein the casing and the side seal are made of a synthetic resin.

* * * * *